US008550780B2

(12) United States Patent
Müller et al.

(10) Patent No.: US 8,550,780 B2
(45) Date of Patent: Oct. 8, 2013

(54) DEVICE FOR SEALING A ROTATING SHAFT

(75) Inventors: Markus Müller, Heidenheim (DE); Markus Deeg, Heidenheim (DE)

(73) Assignee: Voith Patent GmbH, Heidenheim (DE)

( * ) Notice: Subject to any disclaimer, the term of this patent is extended or adjusted under 35 U.S.C. 154(b) by 435 days.

(21) Appl. No.: 12/833,053

(22) Filed: Jul. 9, 2010

(65) Prior Publication Data

US 2011/0008169 A1 Jan. 13, 2011

(30) Foreign Application Priority Data

Jul. 10, 2009 (DE) ..... 10 2009 032 787

(51) Int. Cl.
*F04D 29/12* (2006.01)

(52) U.S. Cl.
USPC ..... 416/174

(58) Field of Classification Search
USPC ..... 416/245 A, 245 B; 277/304, 318, 361, 277/364, 365, 370, 371, 387, 927; 415/230
See application file for complete search history.

(56) References Cited

U.S. PATENT DOCUMENTS 4,078,809 A * 3/1978 Garrick et al. ..... 277/304
4,984,811 A * 1/1991 Kuwabara et al. ..... 277/563
5,529,315 A * 6/1996 Borrino et al. ..... 277/352
5,643,026 A * 7/1997 Pietsch et al. ..... 440/112
5,683,278 A * 11/1997 Pietsch et al. ..... 440/112
5,795,199 A * 8/1998 Langenberg et al. ..... 440/79
6,481,720 B1 * 11/2002 Yoshida et al. ..... 277/400
2002/0111092 A1 * 8/2002 Bergen ..... 440/112
2003/0006561 A1 1/2003 Takahashi et al.
2008/0061514 A1 3/2008 Suzuki

FOREIGN PATENT DOCUMENTS

GB 108307 7/1918

OTHER PUBLICATIONS

Office Action dated Dec. 22, 2010 in corresponding EP application No. 10007047.3.

* cited by examiner

*Primary Examiner* — Nathaniel Wiehe
*Assistant Examiner* — Brian O Peters
(74) *Attorney, Agent, or Firm* — Faegre Baker Daniels LLP

(57) ABSTRACT

A device serves the purpose of sealing a rotating shaft for use under water. It exhibits face seals which seal a work area against the water. In accordance with the invention the face seals are constructed in the form of three slide ring pairs, wherein between the three slide ring pairs two areas (18, 21) are arranged. One of the areas is a sealing area adjacent to the water filled with a first medium and the other area is a leaking area adjacent to the work area. In the sealing area the first medium is held at a pressure level which is higher than the pressure of the adjacent water.

23 Claims, 4 Drawing Sheets

DEVICE FOR SEALING A ROTATING SHAFT

The invention relates to a device for sealing a rotating shaft for use under water.

Devices for sealing rotating shafts for use under water, for example for ship propellers or the like, are in and of themselves known from the state of the art. In principle there are two different ways to realize such sealing.

The one variant consists in inserting face seals which can be constructed comparatively easily. Moreover, with regard to the friction arising in the region of the sealed shaft, face seals are superior to other sealing concepts due to the lower friction. However, face seals exhibit the disadvantage that they are somewhat problematic with regard to the seal tightness, and as a result, should the occasion arise, particles of dirt can penetrate along the sealed rotating shaft in the region that is to be sealed. This is in particular problematic in the case of use in water that is fraught with sediments. Moreover a medium that is located in the sealed region, for example gear oil, can be introduced into the water due to possible leakiness of the face seals, which leads to pollution of the environment.

One alternative to the use of the face seals are lip seals, which due to their design in general permit a greater seal tightness of the seal. These lip seals in the process have the disadvantage that they exhibit a low pressure load capacity and with this are correspondingly expensive and elaborate in production. Moreover the individual lip regions are comparatively sensitive, so that in the case of the installation or, where applicable, penetrating sediment there can very quickly be damaging to the sealing lips or individual regions of the sealing lips. With this also in the case of the use of lip seals the secure and reliable sealing of the rotating shaft can no longer be guaranteed, with the disadvantages mentioned above.

In the case of the use of lip seals it is further known to construct a sealing chamber between two sealing units which are arranged along the rotating shaft in succession, said sealing chamber being adjacent on the one side to the water and on the other side to the work area. Through a corresponding excess pressure in the sealing chamber it is then possible to prevent the penetration of sediments. This structure has in the process the disadvantage that a sealing chamber which is filled with a medium under excess pressure, in the case of leakiness this medium on the one hand is dispensed into the water and on the other hand into the oil. If now a medium is used which is compatible with the oil in the work area, it can correspondingly damage the surroundings of the water. If a medium compatible with the water is used, there can be damage in the case of penetration into the work area, since it mixes with the oil normally located there and negatively influences its desired lubricating properties.

It is therefore the object of the present invention to create a device for sealing a rotating shaft for use under water which prevents the above named disadvantages and in the case of simple and cost-effective structure with minimal friction guarantees a sealing which in the case of a possible leak is safe both for operation as well as also for the environment.

The inventive structure, in which the face seals are constructed in the form of three slide ring pairs, wherein between the three slide ring pairs two regions arise which seal the work area opposite the water, is especially efficient since in place of the complex and elaborate lip seals it manages with the simpler face seals, which in addition exhibit a lower friction between the units to be sealed. With this a simple, reliable and efficient sealing can be realized. In the process, a first sealing area adjacent to the water is filled with a first medium, which exhibits a higher pressure than the adjacent water. As a result it is ensured that no water and no sediments transported with the water penetrate into the region of the seal. Possible leaks would be compensated by the first medium flowing through such a leakage into the region of the water. For this reason no water can penetrate.

Through a pressure drop proceeding from the clean first medium in the sealing area to if applicable water soiled with sediment or seawater, said pressure drop being actively monitored and maintained, a penetration of the seawater can be securely prevented. Between the sealing area and the work area, which typically exhibits an electromotor or is constructed as a motor or transmission area, and which can be filled with a lubricant, for example oil, there lies a further region, which is designated as a leakage area. Possible leaks both of the work area as well as also of the sealing area would now at the most cause a discharge of the transmission oil and/or of the first medium into this leakage area. Therewith it can be ensured that a penetration of the first medium into the work area on the one hand and a penetration of the oil frequently to be found in the region of the first medium and from there if applicable to the region of the water can be securely prevented.

The structure is simple in design and can be realized correspondingly cost-effectively due to the comparatively simple and efficient face seal. Through the suitable selection of the first medium, for example a water-glycol mixture or a water-compatible oil, it can be achieved that in the case of a possible leak occurring contaminations of the water with non-degradable substances that severely pollute the water, such as for example mineral oils, can be securely and reliably prevented.

In an especially favorable and advantageous improvement in the process at least the pressure level in the sealing area is recorded and actively regulated in a predefined size range. Therewith the pressure level for the sealing area, which is very important for the functionality, can be actively held at a level which is always safely above the pressure level of the adjacent water and the pressure level of the adjacent leakage area.

In accordance with an especially favorable embodiment of the inventive device provision is further made that the leakage area exhibits a pressure level which is lower than the pressure level of the adjacent work area and is lower than the pressure level of the adjacent sealing area. Through this embodiment of the leakage area at a low pressure level, so that there is a pressure sink above the cross-section of the individual regions in the leakage area, the above described is improved in particularly favorable and advantageous manner. Through this arrangement of the individual pressures in the successive areas between the three slide rings in the case of a leakage the penetration of the first medium and of the oil into the leakage area is facilitated and thus an even greater security against a leak between the work area and the water is achieved.

In principle it would of course be conceivable to leave the leakage area empty so that it is only filled with air. Via a corresponding draining or if applicable also a pumping out possible leaks which reach the leakage area from the sealing area and the work area can be removed from it. In accordance with an especially favorable and advantageous improvement of the invention however provision is made that the leakage area is filled with a second medium, in particular a fluid medium. Through this filling of the leakage area with a second medium, in particular a medium which can be mixed with the medium of the work area, an especially favorable structure of the inventive device arises, since through the fluid in the leakage area a lubrication of the areas of the slide rings adjacent to the leakage area is achieved, so that the friction of the rotating shaft is further reduced.

On the basis of the active monitoring of the pressures at least in the sealing area, in particular however also in the leakage area, the values of the respective pressures are besides available as a numeric value. Therewith very easily and without further expenditure a means for the representation of the pressure level in the sealing area and/or the leakage area can be realized. This especially favorable and advantageous embodiment of the inventive device makes it possible to install a kind of warning function as a side effect of the monitoring and regulation of the pressures in the areas. As soon as the pressures or one of the pressures falls below or exceeds a predefined limit or changes by a gradient lying above or below a limit gradient a warning can be emitted, for example that the device is to be checked, since said device if applicable exhibits a leak. In addition the active monitoring and regulation of the pressures makes possible for example via an impact with a medium under pressure a change of the fill level or the like, the possibility that the sealing area can be adapted by a changing of its pressures to the respective water depth in which it is being used.

In accordance with an especially favorable and advantageous improvement of the invention provision is moreover made that the maintenance of the pressure level in the sealing area and/or of the pressure level in the leakage area takes place via direct or indirect impact with compressed air.

The areas or the media in the areas can in accordance with this especially favorable and advantageous embodiment be constructed in such a way that they are directly impacted with compressed air in order to hold the predefined pressure level. As an alternative or in addition to this it would of course also be conceivable in place of a direct impact, in which case the compressed air could, should the occasion arise be mixed with the medium, to realize the impact through a membrane sealed to the compressed air and the medium, so that it is ensured that the compressed air cannot mix with the medium and hence the pressure level can be maintained securely and reliably in the fluid medium which under normal conditions cannot be compressed.

In an especially and advantageous usage of the inventive device provision is made that said device serves for the sealing of a shaft of a propeller for the driving of an assembly moved forward in the water. Such an assembly can for example be a ship, a floating crane, a dredger or also an offshore drilling platform or the like. For propulsion a propeller of in and of itself known type and means is used, whose shaft can be securely and reliably sealed by the inventive device in ideal manner. Through the structure with the two areas lying between the three slide rings in the process it is ensured that a reliable and sealed structure is realized and that even in case a leak occurs, through the arrangement of the individual areas a contamination of the water for example with oil in the work area can be securely and reliably prevented. Further the penetration of sediments which, should the occasion arise are carried along in the water, can likewise be securely and reliably prevented.

In an especially favorable and advantageous improvement of this usage the propeller is in the process constructed as an azimuth adjustable propulsion system. Such a propeller will typically exhibit a work area lying outside the hull of the assembly, in which a transmission unit is arranged which converts a movement coming from the hull for example in an axis vertical to the water surface to an axis running parallel to the water surface. Such a transmission unit can then be arranged in the work area filled with transmission oil and transfer via the rotating shaft the rotary movement to a propeller. This propeller can then be moved in known manner around the axis that is vertical to the water surface so that said propeller can generate a forward movement in any direction and therewith steer the assembly or support a steering of the assembly. In place of such a propeller with a mechanical transmission unit, which is frequently also termed a rudder propeller, of course the application of an electrically driven propeller would also be conceivable, in which the electromotor required for drive is arranged in the area of the propeller and therewith typically in the region of a pod of the drive. Such a structure is also referred to as a POD drive.

Further advantageous embodiments of the inventive structure for the sealing of a rotating shaft for use under water as well as a suitable usage for this arise in addition from the following described exemplary embodiments, which will be more closely described with the help of the figures.

The figures show the following:

Figure 1:
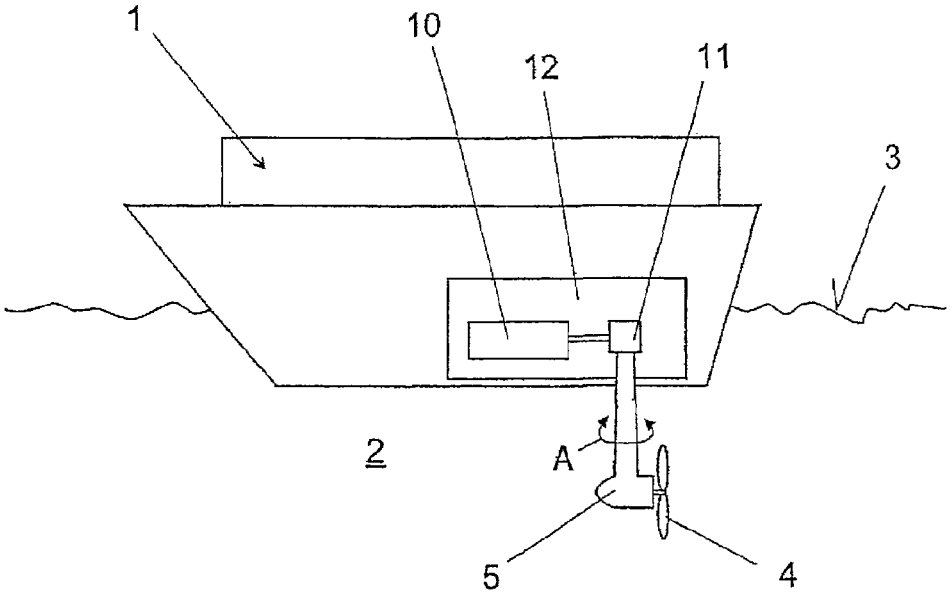
Fig. 1 PRIOR ART
FIG. 1 shows an exemplary representation of an assembly moved forward in the water with an inventive device.

In FIG. 1 very heavily schematized a ship 1 can be recognized as an assembly moved forward in the water. As already mentioned, the structure could also find application in other drives used under water, for example for the drive of floating cranes, dredgers, offshore drilling platforms or other assemblies used under water with rotating shafts which must be sealed from penetrating water and/or media penetrating into the water.

Figure 2:
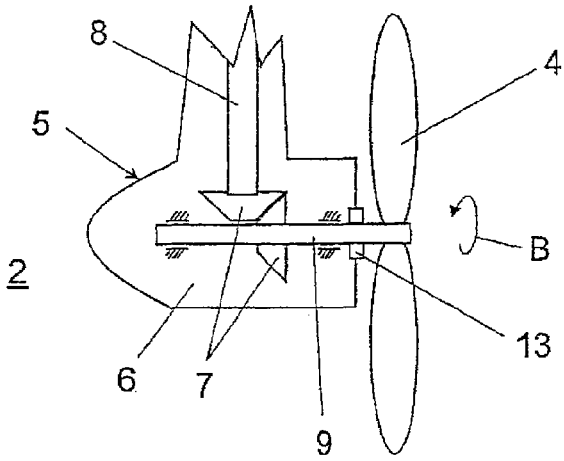
FIG. 2 shows an enlarged section of the pod in accordance with FIG. 1.

The ship 1 shown here as an example is to be operated in the sea water 2, the surface 3 of which being correspondingly signified in FIG. 1. The ship 1 itself exhibits a schematically represented propeller 4 known in and of itself which in the exemplary embodiment shown here is to be constructed as a rudder propeller. This rudder propeller exhibits a pod 5 below the water surface 3, said pod enclosing a work area 6. The work area 6 can be recognized in the enlarged representation of the pod 5 in FIG. 2. In the work area 6 a rotary movement introduced around an axis of axle 8 vertical to the water surface is converted via transmission elements 7 into a rotary movement of a rotating shaft 9 more or less parallel to the water surface 3 for the propulsion of the propeller 4. The work area 6 is filled with transmission oil so that the transmission elements 7 which are represented here purely by way of example and are extremely simplified are lubricated during operation.

The entire structure of the rudder propeller is constructed in such a way that the pod 5 can be moved corresponding to the arrow A in FIG. 1 around the axle 8, so that the propeller 4 can generate forward movement in various directions and thus can be used for the steering of the ship 1 alone or supporting a rudder not shown here.

The structure of the pod 5 will in general exhibit a structure comprising a protective grid for the propeller 4. This is also known and common. However, there is no representation since it was not of further relevance for the present invention.

The drive of the axle 8 takes place in the exemplary embodiment shown here in an in and of itself known manner via a drive aggregate 10, for example a combustion engine, and if applicable a further transmission 11 in a working area 12 which is arranged above the rotating shaft 9, in general in the interior of the ship 1. This structure shown up to this point in the process corresponds to the structure know from the prior art. In order to appropriately seal the rotating shaft 9, which drives the propeller 4 in operation in the direction shown by arrow B, so that a seal can be realized between the water 2 and the work area 6, a corresponding device 13 for sealing is provided. In the following this device 13 will be covered in detail.

As an alternative to the structure of a so-called rudder propeller described here by way of example, in which the power is transferred mechanically to the area of the pod 5 and therewith to the propeller 4, of course a so-called POD drive would also be conceivable. In the case of this structure in the area of the pod 5 an electromotor for driving the shaft 9 would then be arranged right next to it, so that said shaft can only be operated via an electrical power source in the interior of the ship 1 and via electric lines leading to the pod 5. The representations apply in the following figures analogously for such a drive, said figures continuing to use the example of a rudder propeller in their descriptions.

Figure 3:
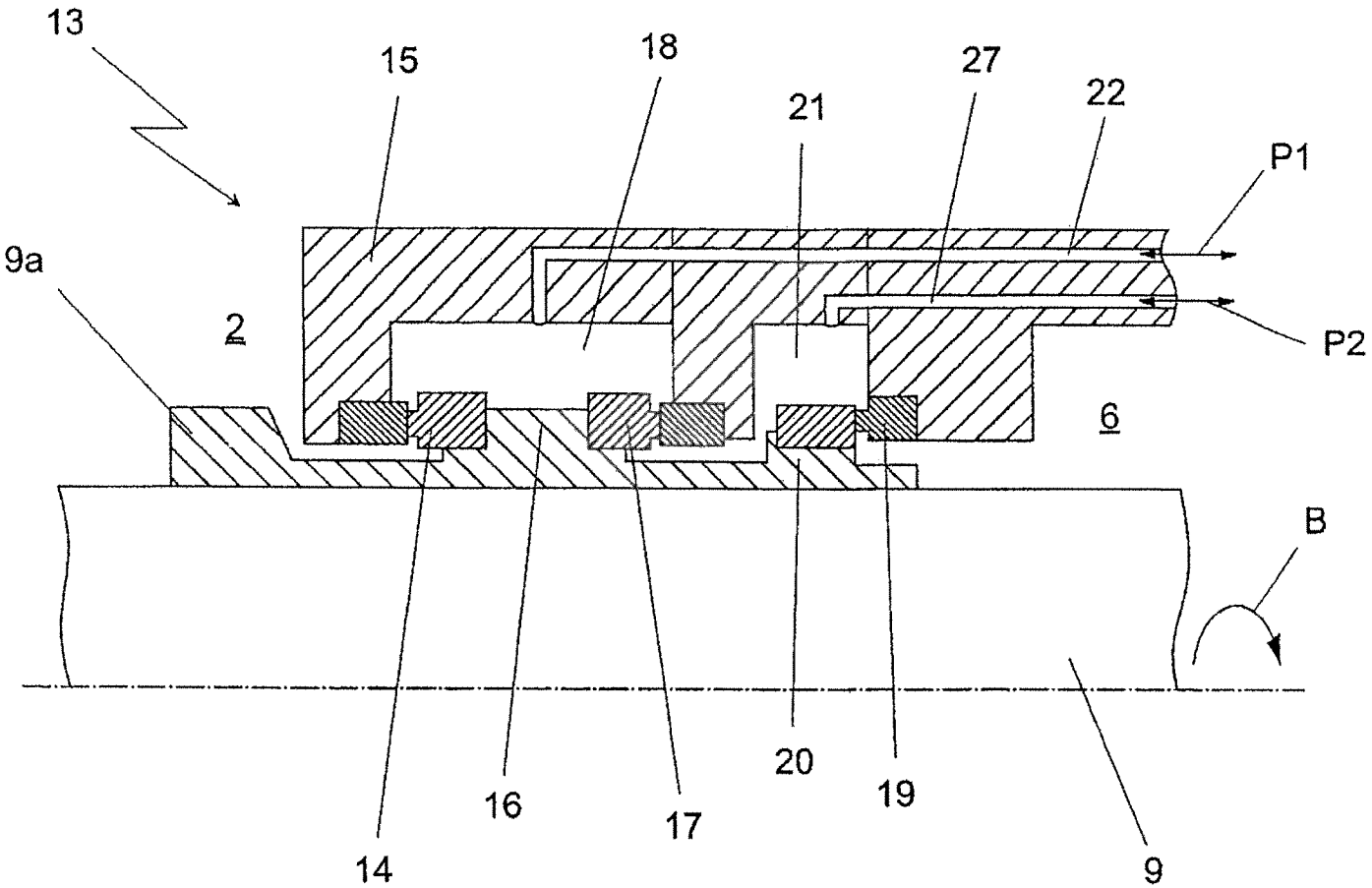
FIG. 3 shows a schematic representation of a device for sealing a rotating shaft.

In the representation of FIG. 3 now the part of the device 13 relevant for sealing will be shown again in detail. In the process one half of the rotating shaft 9 is to be recognized in one section. In the exemplary embodiment shown here the work area 6 is arranged on the right side of the rotating shaft 9. The water or seawater 2 is on the left side of the section of the rotating shaft 9 shown here, said water or seawater in which the propeller 4 not shown again in FIG. 3 correspondingly rotates. The device for sealing 13 now comprises adjacent to the water a first slide ring or a first slide ring pair 14, which seals a housing element 15 connected to the pod 5 opposite the rotating shaft 9 or a rotationally symmetric attachment 9*a* constructed on it. The slide ring 14 is to this purpose arranged with its corresponding counter-element on a first protrusion 16 of the attachment 9*a*. A second slide ring or a second slide ring pair 17 likewise seals the first protrusion 16 opposite the housing 15 on its side turned away from the water 2, so that between the two slide rings 14 and 17 an area referred to in the following as sealing area 18 is constructed. A third slide ring or a third slide ring pair 19 seals the work area 6 opposite the rotating shaft 9 or a second protrusion 20 on the attachment 9*a*. Here too the configuration of the slide rings 17, 19 or of the housing 15 is constructed in such a way that an area referred to in the following as leakage area 21 is formed between the two slide rings 17, 19 and the rotating shaft 9.

The structure of the device 13 for sealing the rotating shaft 9 thus uses three slide rings 14, 17, 19, which between themselves and the rotating shaft 9 or the housing 15 surrounding it form the sealing area 18 and separately from it the leakage area 21. In the exemplary embodiment shown here the location of the individual slide rings 14, 17 and 19 is in the process selected in such a way that they form a sealing surface which is arranged on a plane vertical to the rotating shaft 9. As an alternative to this it would also in principle be conceivable to place the slide rings in a sealing manner in a surface formed in circumferential direction to the shaft 9.

The structure shown in FIG. 3 is now selected in such a way that in the sealing area 18 a higher pressure prevails than the pressure in the water surrounding the device 13 and also higher than the pressure in the leakage area 21, likewise adjacent to the sealing area 18. This pressure is to be maintained via a line element 22 and a pressure control system signified by the reference symbol P1 as well as the arrow. As shown by way of example in the following FIG. 4, the pressure control system P1 can for example be realized by means of a storage tank 23 arranged in the working area 12. The storage tank 23 can for this purpose for example be connected to a first compressed air source 24. In the first line element 22 and the first storage tank 23 as well as in the sealing area 18 in the process a medium, in particular a fluid medium is introduced. This fluid medium on the one hand serves the purpose of wetting and lubricating the corresponding areas of the two slide rings 14, 17 and can on the other hand maintain the pressure in the sealing area 18. The pressure can, on the basis of the fluid first medium, which cannot be compressed under normal conditions for example be recorded in the area of the first storage tank 23 or of the first line element 22, for which purpose a sensor 25 is indicated here. Pressure sensed by sensor 25 can be recorded as a recorded pressure value and can be evaluated in an electronic device 26 and will be used in accordance with the arrow shown dashed for influencing the compressed air source 24 in order to maintain a predefined pressure level in the storage tank 23 and therewith in the first medium in the storage tank 23, the line element 22 and the sealing area 18. Electronic device 26 may include a recording device and/or a means for representing a pressure level such as a display.

In principle a pure connection to a standpipe would also be conceivable for the leakage area 21, so that in the leakage area 21 the prevailing ambient pressure over the water surface appears. In the exemplary embodiment shown in FIG. 4 however a structure is selected which via a line element 27, a storage tank 28, a further compressed air source 29 as well as a sensor 30 with the electronic device 31 is essentially implemented comparably to the structure for the sealing area 18. In the representation of FIG. 3 this pressure control system is also signified as pressure control system P2 by an arrow. In place of the two compressed air sources 24, 29 shown in FIG. 4 of course a compressed air source which can provide two different pressures in the first storage tank 23 and the second storage tank 28 via suitable valve devices would also be conceivable.

The structure of the device 13 for sealing the rotating valve 9 can now be used in different water depths depending on whether a ship, a crane, an offshore drilling platform or the like is to be propelled via the propeller 4. In the case of typical water depths between 8 m and 30 m below the water surface 3 a pressure of circa 0.8 to 3 bar will be present in the water 2. The pressure level in the sealing area 18 will now be adapted according to this predefined pressure to that of the water 2 surrounding the device 13. The pressure level in the sealing area 18 is in the process from 0.5 to 3 bar, preferably 1.5 bar higher than the pressure in the neighboring water 2. If one proceeds from the example just named of a water pressure of 0.8 to 3 bar, in the sealing area 18 a pressure level of the order of 2.3 to 4.5 bar will appear in the preferred embodiment. This pressure level predefined corresponding to the water depth of the propeller 4 will then be maintained via a corresponding monitoring via the sensor 25 as well as the electronic device 26 and a suitable control of the pressure via the compressed air source 24. In the adjacent leakage area 21 a lower pressure level now prevails than in the sealing area 18. The pressure level in the leakage area 21 will in the process be lower than the pressure of the adjacent sealing area 18 by at least 0.5 bar, especially preferably by at least 1.5 bar. With the previously named numerical examples this means that the pressure level will range from 0.8 to 3 bar. In the process a lower value is preferable, so that here by way of example a pressure level of circa 0.8 bar should be assumed. This pressure level will be correspondingly monitored in the structure in accordance with FIG. 4 similar to the pressure level in the sealing area 18 also in the leakage area 21 over the structure with the pressure sensor 30 and electronic device 31 and maintained by the suitable influence of the compressed air source 29.

Now the structure is such that transmission oil is present in the work area 6. This transmission oil will be at a pressure level in the work area 6 which is above the pressure level of the water 2 by at least 0.1 bar, preferably by at least 0.3 bar. If one to the previously named numerical example, this would mean that the transmission oil is present at a pressure of circa 1.1 to 3.3 bar.

In the regular operation of the device 13 through this purposeful arrangement of the pressure levels it is now ensured that the area of the highest pressure level is the sealing area 18, while the area of the lowest pressure level is the leakage area 21. If there should now be a leak for example between the sealing area 18 and the water 2, thus in the area of the first slide ring 14, on the basis of the excess pressure in the sealing area 18 no water will penetrate into the device, but rather only the first medium present in the sealing area 18 will be removed into the water in a small quantity. A medium with good compatibility to the water is therefore to be chosen as the first medium in the sealing area 18, so that in the case of a possible penetration into the water no contamination occurs. Examples would be corresponding bio-oils which are degradable without problems, or also a suitable mixture of water and frost protection agent. If there should be corresponding leaks on the other side in the area of the second slide ring 17, this first medium will likewise not flow outward, but rather penetrate into the leakage area 21 and mix with the second medium located there. This medium can for example be a mineral oil, which is in particular compatible with the transmission oil, so that in the case of possible leaks in the area of the third slide ring, in which case transmission oil could flow into the leakage area 21, a corresponding mixing of the media can take place. Through the pressure sink which is always present in the leakage area 21 during operation potential leaks will always take place in the direction of the leakage area, so that even in the case of leaks, at least for a certain period of time, a secure and reliable operation of the device will continue to be guaranteed.

The device 14 is however not only correspondingly secure in the case of slight leaks of the slide rings 14, 17, 19, but rather also if one of the slide rings were to completely fail. For example if the slide ring 14 completely failed, the seawater 2 would penetrate into the sealing area 18. Then the corresponding pressure level in the sealing area 18 would no longer be able to be maintained. This would be detected by the electronic device 26, for example by the falling below or exceeding of a predefined pressure value or by the pressure dropping by so great a gradient through the flowing out of the medium into the seawater that said gradient would be above a defined gradient of the regulated change of pressure. In this case an alarm could be triggered via suitable means for description of the system, said alarm indicating that slide ring 14 had failed. As a result then the sealing area 18 would fill with the seawater 2 and be at the same pressure level as the water in the surrounding area of the device 13. If one refers to the numerical examples previously given this would be a pressure of circa 0.8 to 3 bar. Since in the adjacent leakage chamber 21 is at the most the same, however typically a lower pressure of 0.8 bar still prevails, a potential leak both of oil from the work area 6 as well as of the seawater 2 located in the sealing are 18 would always flow into the leakage area 21 which is at the same or a lower pressure level. A direct contamination or a direct contact between the transmission oil in the work area 6 and the seawater 2 can even then still be securely and reliably prevented. Due to the possibility of detecting this leak via an electronic device, the propeller 4 can continue to be operated in a type of emergency operation until the device 13 is serviced as soon as possible.

However, if in this situation the second slide ring 17 also failed, slide ring 19 would still guarantee a basic sealing of the work area 6 from the water 2.

A second conceivable failure variant would be the failure of the second slide ring 17. In this case the first medium from the sealing area 18, which is under a higher pressure, would penetrate into the leakage area 21 and trigger a comparable warning as previously described for the sealing area 18 in the area of the sensor 30 or of the electronic device 31. In the final stage of such a leak then the first medium from the sealing area 18 would be present not only in the sealing area, but rather also in the leakage area 21, to be precise, related to the above named numerical example, at a pressure level of circa 2.3 to 4.5 bar. In this case the now connected sealing areas 18 and leakage areas 21 would constitute a kind of sealing chamber which through the excess pressure would continue to seal and deter sediments from the seawater 2 and on the other hand would prevent an escape of oil from the work area 6 through the excess pressure that is present here. In the worst case fluid from these common areas would penetrate into the area of the oil and should the occasion arise, make said fluid unusable. Since this, however, takes place over a longer period of time due to the possible warning here too a rapid servicing of the device 13 would be possible. In any event however, a contamination of the water 2 with the transmission oil from the work area 6 will be prevented.

The third conceivable case of a malfunction lies in a failure of the third slide ring 19. In this case due to the lower pressure level in the leakage area 21 the transmission oil would flow to the leakage area 21 and through a corresponding pressure increase in the sensor 30 in turn a warning or detection of this state could take place. The leakage area 21 and the work area 6 in the above described exemplary embodiment would then be filled with a pressure of 1.1 to 3.3 bar and with a mixture of the transmission oil as well as with the second medium from the leakage area 21 that is compatible with the transmission oil. As opposed to this the sealing area 18, which still has a pressure level of 2.3 to 4.5 bar, would in any event exert a sealing effect, since potential leaks would not take place in the direction of the work area 6 to the water 2, but rather at the most from the sealing area 18 in the direction of the leakage area 21 which would then be connected to the work area 6. Also in this case a secure sealing between the oil in the work area 6 and the water 2 surrounding the device 13 would continue to be guaranteed.

Figure 4:
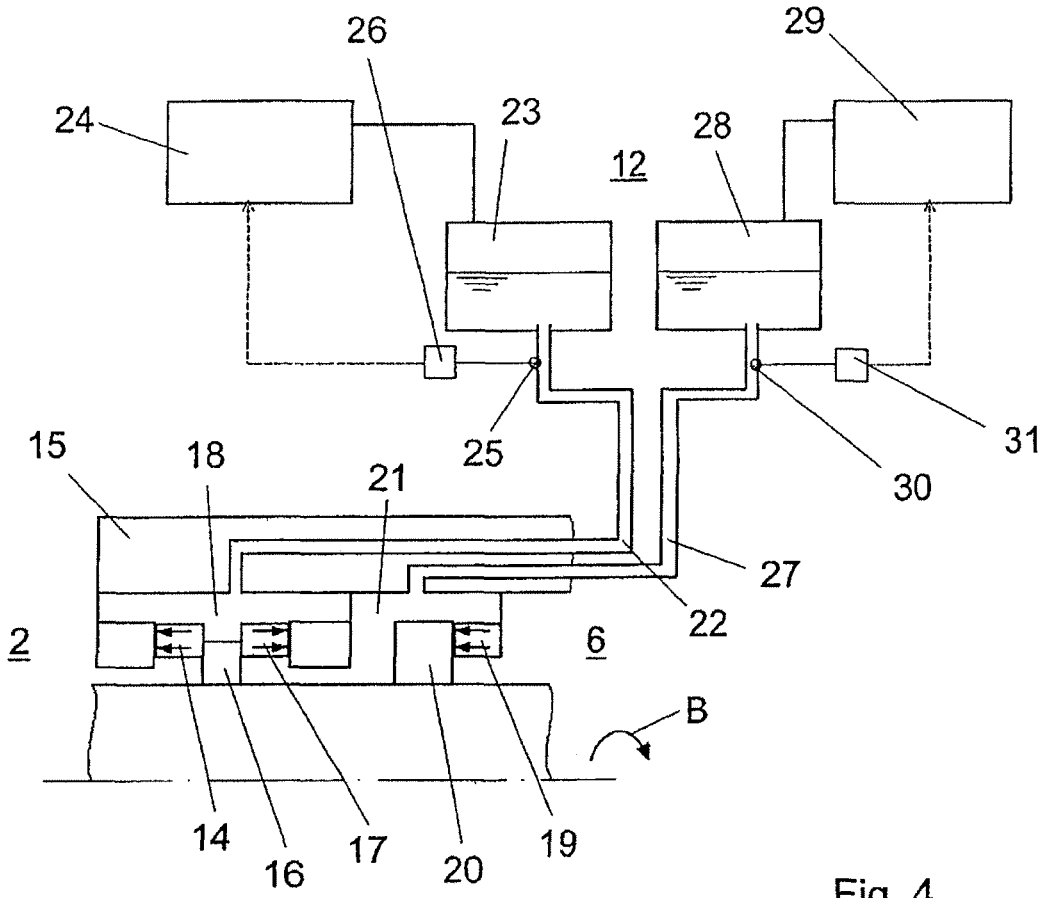
FIG. 4 shows a pressure control for the device in accordance with FIG. 3 in a first embodiment.
Figure 5:
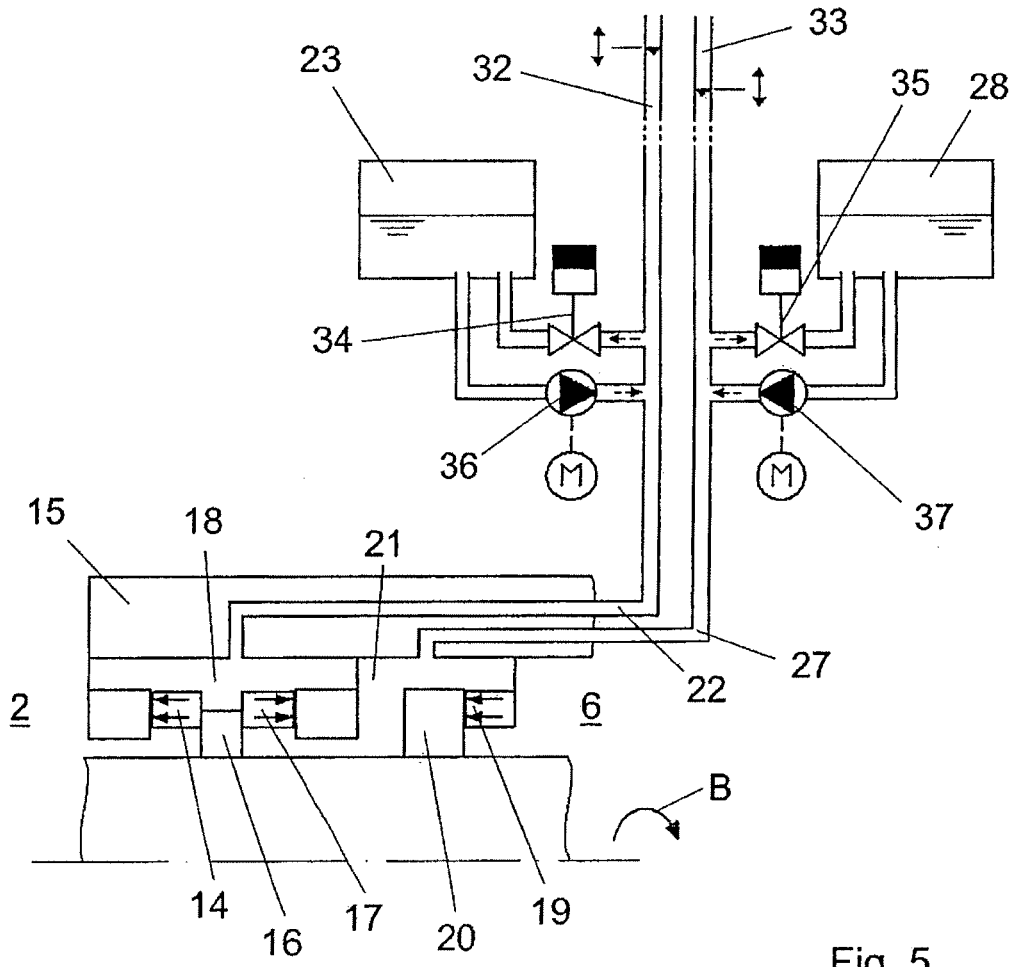
FIG. 5 shows a pressure control for a device in accordance with FIG. 3 in an alternative embodiment.

In the representation of FIG. 5 a structure is shown for which in essence the same applies as for the structure described in FIG. 4. The only difference between the figures lies in the fact that in place of the pressure regulation of the first medium in the sealing area 18 and of the second medium in the leakage area 21 via compressed air a corresponding arrangement is realized with standpipes 32 or 33. The two storage tanks 23 and 28 are in this case connected via valve devices 34 and 35 to the respective standpipes 32 and 33. A further connection to the standpipes 32 and 33 arises via a further line as well as conveying equipment 36 and 37 located within. In the case of a closed valve and operating conveying equipment medium can be pumped into the area of the standpipes 32 or 33, while by opening the valves 34, 35 medium can be taken from the standpipes. The amount of the medium in the standpipes in the process determines the pressure of the medium and with this also the pressure in the respective area 18 or 21. The structure thus permits as an alternative to the previously described maintenance of the pressure via compressed air the maintenance exclusively due to the geodetic height of the fluid in the standpipes 32 or 33. A visualization of the pressure level could take place via corresponding inspection glasses in the area of the standpipes 32 or 33. Otherwise what has already been stated above applies for the structure represented in FIG. 5.

The invention claimed is:

1. A device for sealing a rotating shaft for use under water, comprising a plurality of face seals which seal a work area against the water, characterized in that the plurality of face seals are constructed in the form of three slide ring pairs, wherein between the three slide ring pairs two areas are constructed, a sealing area adjacent to the water filled with a first medium and a leakage area adjacent to the work area, whereby in the sealing area the first medium is held at a pressure level which is higher than the pressure of the adjacent water.

2. The device according to claim 1, wherein the leakage area exhibits a pressure level which is lower than the pressure level of the adjacent work area and is lower than the pressure level of the adjacent sealing area.

3. The device according to claim 2, wherein the pressure level in the sealing area is recorded and actively controlled in a predefined size range.

4. The device according to claim 2, wherein the pressure level in the leakage area is recorded and actively controlled in a predefined size range.

5. The device according to claim 1, wherein the pressure level in the sealing area is recorded and actively controlled in a predefined size range.

6. The device according to claim 5, wherein the pressure level is controlled by means of direct or indirect impact with compressed air.

7. The device according to claim 5, wherein the pressure level in the leakage area is recorded and actively controlled in a predefined size range.

8. The device according to claim 1, wherein the pressure level in the leakage area is recorded and actively controlled in a predefined size range.

9. The device according to claim 8, wherein the pressure level is controlled by means of direct or indirect impact with compressed air.

10. The device according to claim 1, wherein the leakage area is filled with a second medium.

11. The device according to claim 1, wherein at least one of the leakage area and the sealing area is connected via line elements to a working area lying above the rotating shaft.

12. The device according to claim 1, wherein the pressure level in the sealing area is above the pressure of the adjacent water by 0.5 to 3 bar.

13. The device according to claim 12, wherein the pressure level in the sealing area is above the pressure of the adjacent water by 1.5 bar.

14. The device according to claim 1, wherein the pressure level in the leakage area is at least 0.5 bar below the pressure in the adjacent sealing area.

15. The device according to claim 14, wherein the pressure level in the leakage area is at least 1.5 bar below the pressure in the adjacent sealing area.

16. The device according to claim 1, wherein the pressure level in the work area is at least 0.1 bar above the pressure level in the adjacent leakage area.

17. The device according to claim 16, wherein the pressure level in the work area is at least 0.3 bar above the pressure level in the adjacent leakage area.

18. The device according to claim 1, wherein the slide ring pairs are constructed in such a way that the sealing surface of at least one of the face seals is arranged in such a way that it is constructed on a plane vertical to the rotating shaft.

19. The device according to claim 1, wherein means for the representation of the pressure level in at least one of the sealing area and the leakage area are present.

20. The device according to claim 19, wherein the means for the representation of the pressure level can represent at least one of the exceeding or falling below of a predefined limit, and the decline or increase with a gradient above a limit gradient of the predefined pressure level(s).

21. The device according to claim 1 in combination with a shaft of a propeller for a drive of an assembly moving forward in the water.

22. The device according to claim 21, wherein the propeller is constructed as an azimuth adjustable propulsion system.

23. The device of claim 1, wherein the plurality of face seals are constructed in the form of only three slide ring pairs, wherein only two areas are designed between the three slide ring pairs.

* * * * *